United States Patent [19]

Bjelland et al.

[11] 4,124,136

[45] Nov. 7, 1978

[54] CONTAINER LINER FRAME SUPPORT KIT

[75] Inventors: Ronald W. Bjelland, Valley Stream; Charles A. Narwicz, Greenlawn, both of N.Y.; Casimir Hetmanski, Westfield, N.J.

[73] Assignee: United States Lines, Inc., New York, N.Y.

[21] Appl. No.: 608,470

[22] Filed: Aug. 18, 1975

Related U.S. Application Data

[62] Division of Ser. No. 416,580, Nov. 16, 1973, Pat. No. 4,054,226.

[51] Int. Cl.[2] ..... B60P 7/00; B61D 17/18; B62D 33/04; B65D 25/16

[52] U.S. Cl. ..... 220/68; 222/105; 248/95; 296/39 R; 403/63; 403/166; 105/423; 105/489; 160/352; 160/368 G; 206/223; 211/182

[58] Field of Search ..... 248/105, 351, 127, 95, 248/97, 99, 354 P, 354 S, 356, 357; 52/2, 63, 222, 248, 633, 645, 646, 653, 656, 721; 105/376, 423, 489, 490, 491, 492, 493, 494, 495; 160/368 G, 415, 352, 368 R, 372, 374, 376, 377; 211/182; 214/9, 16 R, 17 R, 17 A, 82, 44 R, 44 C, 701; 220/1, 5, 6, 3 A, 63 R, 64, 65; 222/105; 280/179 R; 296/24 R, 39 A, 39 R; 403/63, 106, 165, 166; 206/223, 216, 231, 321, 335, 577

[56] References Cited

U.S. PATENT DOCUMENTS

| | | | |
|---|---|---|---|
| 192,652 | 7/1877 | Moule | 248/97 |
| 794,469 | 7/1905 | Sherwood | 160/376 X |
| 1,238,571 | 8/1917 | Rosenthal | 211/182 X |
| 2,357,819 | 9/1944 | Greer | 160/377 X |
| 2,949,866 | 8/1960 | Ford | 105/376 X |
| 3,079,986 | 3/1963 | Ford | 160/87 |
| 3,139,998 | 7/1964 | Seaman | 214/82 |
| 3,149,664 | 9/1964 | Keating | 160/368 G X |
| 3,398,778 | 8/1968 | Veach, Jr. et al. | 160/45 |
| 3,418,005 | 12/1968 | Allina | 296/391 R X |
| 3,583,466 | 6/1971 | Dreyer | 160/377 X |
| 3,672,492 | 6/1972 | Sherr | 206/321 |
| 3,756,469 | 9/1973 | Clark et al. | 222/105 |
| 4,054,226 | 10/1977 | Bjelland et al. | 105/423 X |

*Primary Examiner*—Albert J. Makay
*Assistant Examiner*—Howard Beltran
*Attorney, Agent, or Firm*—Brooks, Haidt, Haffner & Delahunty

[57] ABSTRACT

Structural front and rear frames, and a rear bulkhead mounted on the rear frame, mount and securely retain a flexible bag as a liner within a freight container, truck trailer or the like, to adapt the container for bulk cargo transport. The front frame retains the front end of the liner bag in generally rectangular configuration and transmits stresses on the bag to structural members of the container, thus supporting the front end of the bag against displacement and possible damage or rupture. The rear frame and a curved bulkhead mounted thereon support the rear end of the bag and similarly prevent its rupture or collapse during loading and tilt-unloading. The laterally curved rear bulkhead also acts as a funnel to completely evacuate the bag contents during tilt-unloading through an opening therethrough. The arrangement is inexpensive and easy to install and, although all of its components may be disposed of after a single use, at least the frame components can be reused.

7 Claims, 9 Drawing Figures

56
17
78
20
20a
45
46
70
75
74
22
77
10
13
B
78
24
19

16
12
16
38
30
35
34
37
39
21
17
36a
36
11
33
32
40
23

CONTAINER LINER FRAME SUPPORT KIT

This application is a division of application Ser. No. 416,580 filed Nov. 16, 1973, now U.S. Pat. No. 4,054,226, issued Oct. 18, 1977.

The present invention relates to the handling of bulk cargo and more particularly to means by which a large plastic liner bag can be mounted in a conventional freight container, particularly the familiar road-hauled trailer vans, for the transportation of bulk cargo. These containers are now a conventional adjunct in modern marine transportation networks.

Standardized containers or boxes have come into very extensive use for the "containerized" shipment of freight by land and sea, and the manifest advantages of such containers have made it extremely desirable to adapt them for use with as many types of cargos as possible. Accordingly, these have been attempts, with varying degrees of success, to adapt conventional containers for use as carriers of dry bulk cargo. It is important to keep these containers clean for reuse, with different bulk cargo shortly after unloading, and such bulk cargoes themselves must remain free of contamination by remnants of the last-carried cargo, or by exposure. When handling bulk cargo in the form of powder or fine granules, cargo leakage and spilling problems arise.

As early as 1918 a U.S. Pat. No. 1,262,025, was granted for a removable liner arrangement in a railroad boxcar, but modern freight containers, along with modern loading and unloading techniques, have revolutionized freight transportation. However, the idea of installing a temporary bag liner to adapt such conventional containers to carry bulk cargo has the advantage that, after the cargo is delivered, the liner bag can be removed so that the container is again usable, without significant cleaning, to carry other cargo. There has been an acceleration of the search for reliable and inexpensive ways to handle bulk cargo as efficiently as other kinds of freight, by fitting standard containers with flexible liner bags.

Modern freight containers are widely used for transport by ship and rail as well as by road when mounted on wheeled chassis, and are provided in standard trailer truck sizes of about 8 or 8.5 feet high, 8 feet wide and either 20 or 40 feet in length. Typically, a shipper loads the container which is mounted on a chassis, at the shipper's plant and the loaded container is then hauled by truck to dockside, lifted off the chassis and loaded on board a ship. After transport by ship the container is off-loaded onto another chassis, and again hauled by truck and emptied of its cargo at its destination. The advantages of using containers that remain sealed from the shipper to the ultimate consignee are obvious.

Containers provided by such companies as Fruehauf Trailer Division of Fruehauf Corporation of Detroit, Mich., and Trailmobile, Inc. of Cincinnati, Ohio, are currently used for shipping all types of freight, including bulk cargo. Though originally only break-bulk cargo was containerized, it has been found that bulk cargo can be economically containerized by lining the container with a disposable liner bag. Yet the difficulties in handling such commodities as dry bulk chemicals, acids and starches, powdered and pelletized resins, cement, clay, flour, coffee and grain in such bag liners have not been completely overcome, due to bag rupture under certain conditions of use.

For example, upon opening the rear doors at the time of unloading, there may be substantial rearward force on the bag, and on any conventional temporary bulkhead as may have been installed adjacent to the rear doors, either due to the forces exerted by the cargo in its natural angle of repose, or because the cargo has shifted back during transport. Similarly, upon tilting of the container by elevating its front end for unloading in accordance with a conventional procedure for pouring cargo out through an opening formed at the lower rear of the bag, disposable liner bag arrangements of the prior art have been subject to tearing and collapse especially upon cargo-surging, as commonly occurs. Attempts have been made to solve these problems by using variously braced temporary cardboard and/or wooden bulkheads, or by hanging the bag from the container roof by means of many peripherally located hooks. Merely hanging the bag results in forces being concentrated at the attachment points during unloading, with the danger that the bag will tear by cascading, zipper-like failure at the several hanger locations.

In addition, there has been difficulty in completely emptying the bag contents when using prior liner and bulkhead arrangements in that cargo residue tends to collect in the corner areas at the rear of the container as it is tilt-unloaded. Attempts have been made to alleviate this problem by providing a pair of discharge openings, one at each side of the liner bag adjacent the bottom. However, additional unloading chutes and arrangements are then required.

Among the objectives of the arrangement of U.S. Pat. No. 3,386,605 was the prevention of spillage when the rear doors of a cargo container with a flexible liner are opened. The system of Pat. No. 3,386,605 employs a rigid, wall-like rectangular bulkhead intended to transmit cargo pressures to corner posts of the container.

U.S. Pat. No. 3,696,952 discloses a flexible liner bag and bulkhead arrangement wherein front and rear bulkheads are intended to transmit loads to a container front wall and rear doors respectively.

One kind of temporary bulkhead for restraining load movement by utilizing the natural pressure exerted by the load against the car walls is the reinforced bulkhead provided by Signode Steel Strapping Co., described in the Aug. 29, 1960 issue of "Railway Age". However, temporary bulkheads attached by adhesives or by positive fasteners either require cleaning off of the adhesive or cause damage to the container walls. And, since the prior use of temporary bulkheads has depended on frictional forces along the bulkhead perimeter, or on wedges or the like located strategically at the bulkhead perimeter, misplaced wedges and/or uneven loads cause difficulties.

Moreover, it has been noted that high tearing stresses are induced on front ends of the bags during pressure loading by known procedures, and that tilt-unloading also causes high tearing stresses on the front ends of liner bags of the kind generally described in U.S. Pat. Nos. 3,386,605 and 3,696,952. The arrangements of those patents and of other prior container liner systems have not always been satisfactory in accommodating front end stresses when handling all types of bulk cargo, and the bulkhead arrangements proposed and used for rear ends of containers have usually required external support during tilting unloading, as shown, for example, in U.S. Pat. No. 3,696,952. It is desirable to eliminate the necessity for such external support.

The bulk cargo container liner suspension and bulkhead system of the present invention overcomes the difficulties experienced in prior art attempts to convert standard freight containers to bulk cargo use, by using existing structural components of the container itself to secure the liner bag positively during all modes of container operation. A frame arrangement at the forward end of the container supports a flexible liner bag in a desirable generally rectangular configuration during shipment and evenly distributes stresses during transport and unloading so that even during tilt-unloading there is no danger of tearing or collapse of the forward end of the liner bag. A rear end frame assembly supports a rigid though somewhat flexible arcuately-shaped, vertical bulkhead to provide support to the rear of the liner bag and its contents by transmitting loads to the container structure during transport and during unloading whether by tilting, vacuum or other known processes.

The frames and bulkhead of the invention are inexpensive enough to be disposable after one use, yet sturdy enough to offer further economy and ecological advantage by repeated use. The ease of installation of the suspension and bulkhead system and the attachment of a liner bag thereto further contribute to economy and reliability.

It is believed that the primary forces acting on the bag during discharge occur at the bottom front end of the bag, and hence it is believed necessary to positively restrain the bag at this location. In a currently preferred embodiment the front end frame in accordance with the invention is formed of interfitted tubular sections, which can be ordinary thin-wall pipe sections. A bottom cross member, which during use lies in the angle formed by the juncture between the floor and front wall of the container, has upturned tubular ends which receive side members that extend upwards and rearwards to a roof frame element of the container such as a roof bow. At its lower front end the liner bag is resiliently mounted on this bottom cross member, and at its upper front end the bag is similarly mounted on a top cross member which is attached between respective support members which extend forwardly from the parallel side members. The various tubular members are of such size that, when the frame is in place, the top cross member which supports the top of the liner bag lies against the front wall of the container at a position spaced below the roof. It is also braced upwardly against the undersides of the respective upper corner castings of the container, as will be seen. For installation convenience, and to keep the frame tightly in place during shipment in any of several different makes of containers, the side members are spring biased upwardly by springs fitted within the upturned end portions of the bottom cross member. Thus, in the preferred front frame embodiment the bottom and side members form a "U-shaped" frame which is disposed at a vertical angle between the bottom forward end of the front wall and a roof bow of the container which is spaced rearwardly away from the front wall. The bag is secured along the full length of the bottom cross member so that forces are evenly distributed thereto, reducing stress concentrations and minimizing the chance of tearing. Because of the bracing action of the side members, forces tending to pull the bottom of the bag rearward, as developed during discharge, are transmitted to the roof bow and floor of the container. Forces tending to pull on the upper front end edge of the bag are transmitted by the top cross member to the front wall of the container, as well as rearwardly to the frame side members and thence to the roof bow.

A length of flexible "shock cord" successively looped through grommet holes along the edge of the bag, or even large-sized rubber bands passed through the individual grommet holes, secure the transverse edges of the liner bag respectively to the upper cross member and to the bottom cross member of the front frame. The flexible nature of these hanger materials minimize the possibility for subjecting the bag itself to high shock loads as could cause tearing, and the hanger arrangement more evenly distributes applied forces throughout the several locations of support.

At the rear end of the container, the top edge of the bag is similarly attached to a cross member at the top of the rear frame, and a laterally curved, vertical aluminum bulkhead provides support for the bag and its contents. The rear frame has inverted U-shape appearance, and is formed by two upright but rearwardly canted parallel legs jointed at their upper ends by the cross member. The lower ends of the legs are respectively secured to a transverse bracing or spreader element extending across the width of the container. The legs and cross member of the rear frame can be pipe segments, and the bracing element is made of wood and has recesses and means for receiving and holding the legs in place.

The bracing element is secured along the straight front edge of a flat base member of generally semi-circular plan. Individually cut flaps, forming a bent-in lower edge portion of the vertical and curved aluminum bulkhead sheet, are positioned under the semi-circular rear edge of this base member so that the bulkhead extends therealong and is embraced between the frame legs. Vertically spaced apart, laterally extending steel straps, connected at their ends to the respective leg members, extend around the rear surface of the bulkhead sheet to support the bulkhead against pressure exerted by the liner bag contents. The liner bag itself is secured by flexible fastenings along its upper rear edge to the upper cross member. The bottom of the bag may be similarly secured to the bracing element.

Loads exerted on the rear bulkhead pull on the canted frame legs, to which the bulkhead is attached as aforesaid, and are thereby transmitted to the header and to the lower siderails of the container. The temporary bulkhead is thus fixed in position and is much less likely to be displaced than prior frictionally held temporary bulkheads. The greater the load on the bulkhead, the greater will be the force jamming the frame legs downward and rearward.

During tilt unloading of a container equipped with a rear frame and bulkhead arrangement according to the invention the curved bulkhead provides a "funnel" surface for more complete evacuation of the liner bag contents.

The bulkhead arrangement of the invention does not require the kind of external support needed by prior liner arrangements during unloading, is light in weight, and is adapted for use with containers having different scantlings with respect to the locations of their roof bows, and for use with various types of unloading mechanisms and existing facilities. As an example, the rear bulkhead can be opened centrally at its lower portion to pour out contents through a hole made at the bulkhead opening of the liner bag. Since the bulkhead need not, and preferably does not extend the full height of the container, loading is accomplished in conventional manner after the bulkhead is in its position by filling the bag through a loading aperture above the bulkhead.

These and other objects and advantages of the bulk cargo liner suspension and bulkhead system of the invention will appear more fully from the following detailed description of a preferred embodiment of the invention, when read in conjunction with the accompanying drawings, in which FIG. 1 is an overall view in perspective of a typical freight container equipped with a flexible liner bag and a suspension and bulkhead system according to the invention, internal structure being shown by dotted lines;

Figures 1, 7:
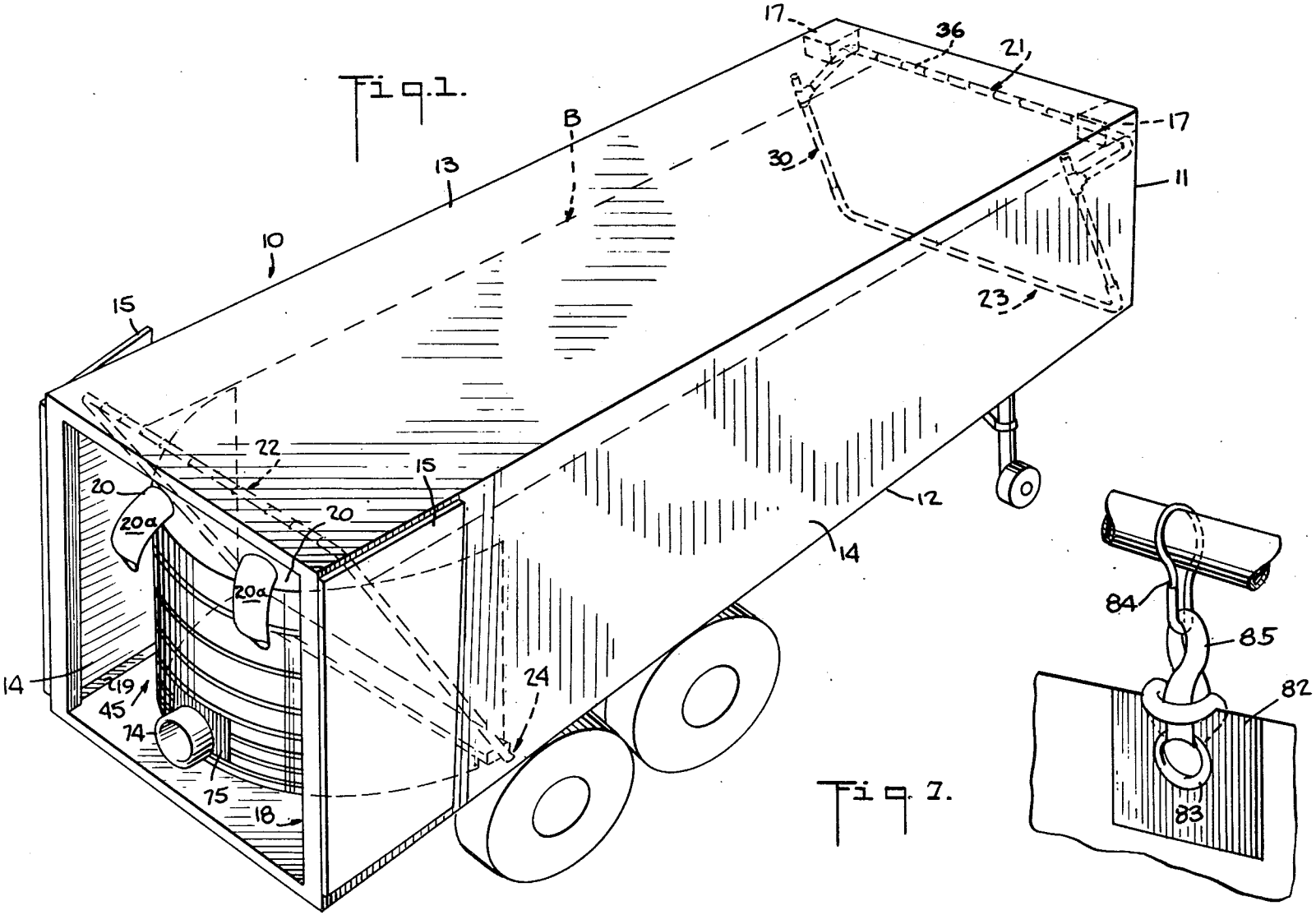
FIG. 7 is an enlarged detail in perspective, showing one means for attachment of a liner bag to the frame arrangement of the invention.
Figure 2:
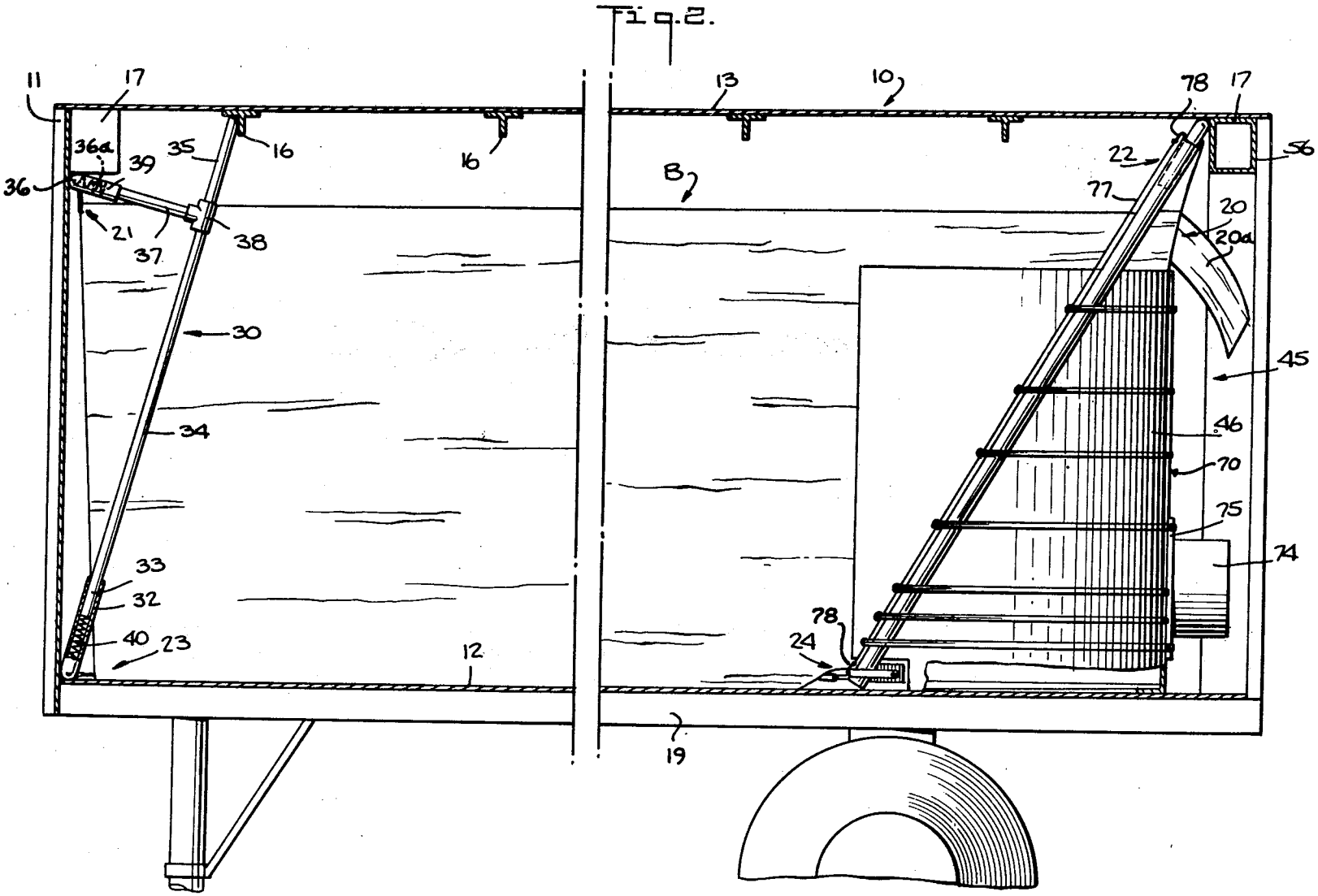
FIG. 2 is a fragmentary side sectional view of the container of FIG. 1.

The conventional van-type freight container 10 shown in FIGS. 1 and 2 is of a type generally used for transport by ship and rail as well as by road when mounted on a wheeled chassis as shown. Containers such as the container 10 are provided in standard trailer truck sizes, about 8 or 8.5 feet high, 8 feet wide and either 20 or 40 feet in length. The generally box-like container 10 has a front wall 11, floor 12, roof 13, side walls 14 and rear doors 15. For simplicity, various structural elements of the container 10 are not shown in the drawing but it will be noted that the roof 13 is supported by transverse members or roof-bows 16 (FIG. 2) shown as T-shaped in cross-section. In some commercially available containers the roof bows are of some other profile, such as channel-shaped, or it is possible that the roof itself might have transversely corrugated construction, but in any case, all conventional closed containers have transverse members or the like supporting or forming their roofs.

It will also be seen that the internal upper corners of the container 10 have structural corner castings 17 of block-like form for handling of the containers by means known in the art. The rear doors 15 are shown as hingedly mounted on a sturdy structural frame 18, including a transverse top member or header 56. Though other door arrangements can be provided the arrangement shown is typical. Longitudinal siderails 19 extend along each side of the container 10 at the floor 12.

Originally containers of the type shown in FIG. 1 were used only for shipment of break-bulk cargo, but it has been found that bulk cargo such as granular or powdered dry bulk chemicals, resins, cement, flour, coffee and grain can be economically containerized for shipment by lining the container with a flexible liner bag. A liner bag B adapted for suspension in the container 10 is shown in FIGS. 1 and 2 and in greater detail in FIG. 6. The liner bag B can be formed as a seamless tube of polyethylene about 6 mils thick, squared and sealed at its ends to provide a 20 or 40 foot long, generally rectangular bag. Since the typical container 10 is about 8 feet by 8 feet in cross-section, the diameter of a tube used to make the bag is about 10 feet. Further details of the bag B according to this invention will be discussed hereafter in connection with FIGS. 6, 7 and 8, but it will be noted that the bag B has two loading apertures 20 through its upper rear wall and is provided with transversely extending attachment areas 21 and 22 at its front and rear upper portions, respectively, similar attachment areas 23 and 24 being provided at its front and rear lower portions.

Liner bags fitted into containers in accordance with prior systems have tended to tear at or near their front ends, particularly at the top, under the forces of shifting cargo within the bags, especially when the container itself is tilted front end up through angles of 45° or more in unloading by pouring bulk cargo out of a discharge opening at the lower rear end of the bag. It is believed that such tearing at the top of the bag is due to insufficient support along the lower portions of its front end. Accordingly, such tearing is prevented by the employment of a front frame 30 according to this invention. The frame 30, as shown in FIGS. 1, 2 and 5, fits adjacent the front wall 11 of the container 10 and extends between the floor 12 and roof 13.

Figure 5:
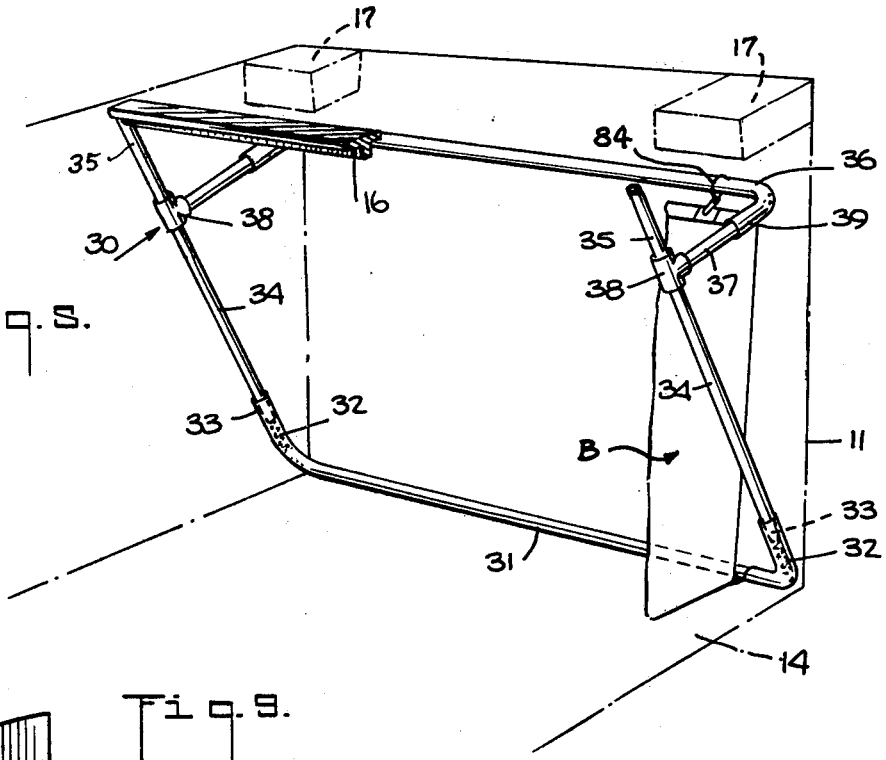
FIG. 5 is a view in perspective of a front frame arrangement according to the invention, including certain structural components of the container in which it is situated, as well as a fragmentary portion of a liner bag to show the relationships therebetween, the relationship between the frame and front wall of the container being slightly different from that illustrated in FIGS. 1 and 2.

Reference is now more particularly made to FIG. 5 which shows the front frame 30 as formed of tubular frame members, which members can preferably be lengths of steel electrical conduit pipe available at low cost. A transverse or bottom cross member 31 extends across and rests on the container floor 12 at the junction between the floor 12 and the container front wall 11 and will restrain the liner bag against rearward movement at its bottom front end. End portions 32 of the bottom member 31 are bent upwardly within the same plane and at right angles to the main elongated body of the member. They extend upwardly and rearwardly with respect to the container 10 as shown, when the frame 30 is installed. These end portions 32 receive within their open upper ends the lower ends 33 of a pair of parallel upright or side bracing members 34 of the frame 30. Taken together the members 31 and 34 form a generally U-shaped structure, positionable within the aforementioned angle junction at the bottom of the front wall 11, and extending upwardly and rearwardly to engagement against the forwardly facing surface of a downwardly projecting structural element of the container roof, i.e. the roof bow 16 of FIG. 5. The upper ends, or portions 35 of the members 34 snugly engage the roof bow 16.

In order to permit pre-assembly of the frame 30 before installation, the invention provides for momentarily shortening the effective height of the sides of the frame 30 by moving the lower ends 33 of the side members 34 downward within the upturned end portions 32 of the bottom cross member 31, against the bias of sturdy springs 40 (FIG. 2) fitted within the portions 32 and abutting against the bottom ends 33 of the side members 34. The springs 40 permit the side members 34 to be pushed downward so that their upper ends 35 can be positioned against the forward side of a roof bow 16. Once the frame 30 is in place the springs 40 urge the upper ends of the members 34 into tight contact with the roof bow 16.

A standard size frame 30 can be established for each of the different standard models of containers made by different manufacturers. Alternatively, and as is preferable, the spring arrangement 40 adapts a single frame for use with containers made by different manufacturers, and whose roof bow locations may differ slightly.

A top cross member 36 of the front frame 30 spans between support members 37 which extend forwardly at right angles to the canted side members 34 so as to extend slightly upward in the installed arrangement. Piping tees 38 at the lower ends of the members 37 are affixed by a snug slip fit, or are secured by set screws or the like, on the side members 34. Preferably, they are adjustable up or down to firm up the cross member 36 against the container front wall 11, preferably immediately beneath the front corner castings 17 as shown in FIGS. 1 and 2, after the side members 34 have been fitted against the container roof bow 16. However, as shown in FIG. 5, the member 36 need not be braced against the undersides of the corner castings 17, but may merely be against the front wall 11. In the preferred embodiment of the front frame 30 shown, the top cross member 36 has its end portions 39 bent or fabricated at right angles, and within the same plane, for reception of the support members 37. Optionally, springs **36*a* (FIG. 2) may be placed within the bent ends 39 biasing these ends and the support members 37 apart. Thus, the frame 30 is so dimensioned that its top cross member 36 engages the container front wall 11 when the frame is in position as shown best in FIG. 2, the slip fit of the tees 38 permitting adjustment as necessary. After placement the tees 38 can be crimped or otherwise locked in place, for example by fasteners such as screws, but it will be noted that the forces acting, and the geometry of the frame 30, wall 11, and front corner castings 17 are such that the top cross member will normally maintain its proper position against the wall 11 without such locking. The top cross member 36 serves the dual functions of maintaining the spread-apart relation of the upper ends 35 of the side member 34**, and providing a rack along which the upper front end of the liner bag may be attached.

Figure 6:
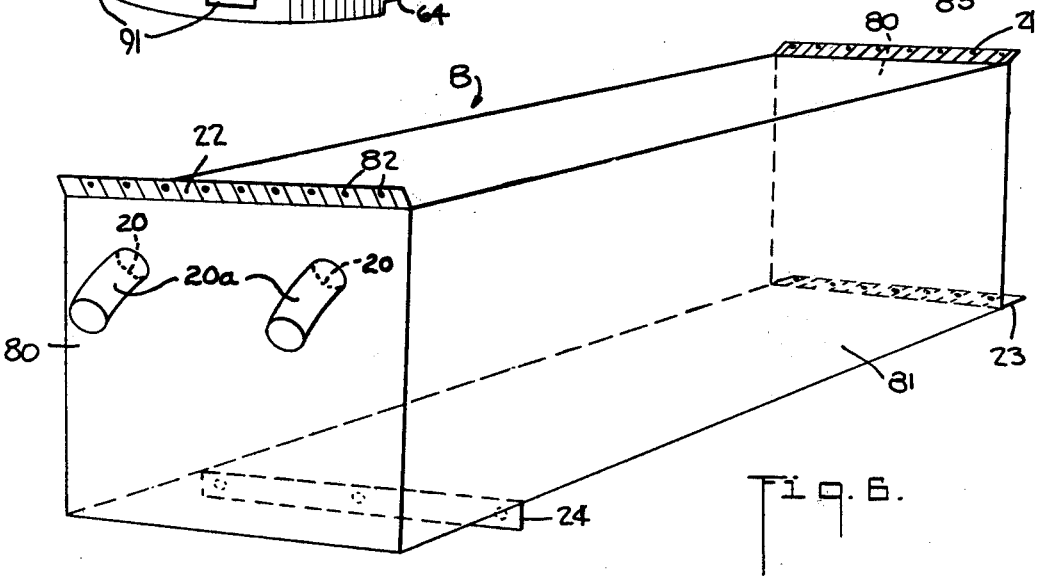
FIG. 6 is a view in perspective of a flexible liner bag adapted for use with the suspension and bulkhead arrangement of the invention.

The front end of the bag B is suspended from the top cross member 36 and secured to the bottom cross member 31 at the attachment areas 21 and 23 of the bag B in a manner which will be described in detail hereafter with reference to FIGS. 6, 7 and 8. The cross member 31, extending as it does across the entire internal width of the container 10, permits attachment and support of the entire width of the bag B along the bottom of its front end.

The frame 30 withstands forces transmitted by loads applied to and through the bag B, and transmits and distributes those forces to and between the floor 12, front wall 11 and roof bow 16 of the container 10, even when the container is tilted for unloading. Although the frame 30 has been described as constituted of tubular pipes it will be understood that rods, bars and even boards can be employed as frame members if desired, pipes as shown being preferred for their strength, lightness of weight and economical availability.

In certain applications of the invention it may be desirable to provide a top member joining the upper end portions 35 of the members 34, to lie against and along the roof bow 16. Such arrangements have added rigidity, but are not believed to be necessary in most cases.

It will also be noted that the front frame 30 as has been described may itself be usefully employed in some known bag liner arrangements to prevent bag rupture at the front end of the container.

However, during shipment, cargo contained in a bag-lined container of the type here described can shift rearward, or otherwise exert considerable pressure against the rear doors of the container. If the container is to be unloaded by tilting, the rear, lower end of the bag and the container doors will be heavily loaded. For these reasons, prior proposals and practices have sought to use heavy, temporary external bulkheads or rigid internal temporary bulkheads braced against the door frame 18, to support the rear end of the liner bag when the container is tilt-unloaded. In the present invention, an internal, fairly light and flexible temporary bulkhead is provided by a generally semi-cylindrical vertical bulkhead member 46 with a supporting frame and base assembly.

It has been found that a sturdy but light and flexible aluminum sheet, easily formed into a curved shape, can be used very effectively as the bulkhead member 46 when reinforced by steel straps as will be described. However, other sheet materials, such as similarly reinforced paperboard or the like could be used. As shown in FIGS. 1–4 the rear bulkhead member 46 when installed is bent or formed to a generally semi-cylindrical curvature. Since the standard container is about 8 feet wide, the length of the sheet forming the bulkhead member 46 should be somewhat over 12 feet. The height of the bulkhead member 46 can be considerably less than the height of the container, which makes it possible to load the bag B through the openings 20 after the bulkhead member 46 is in place. The bulkhead 46 forms a part of the rear frame and bulkhead assembly 45.

Figure 3:
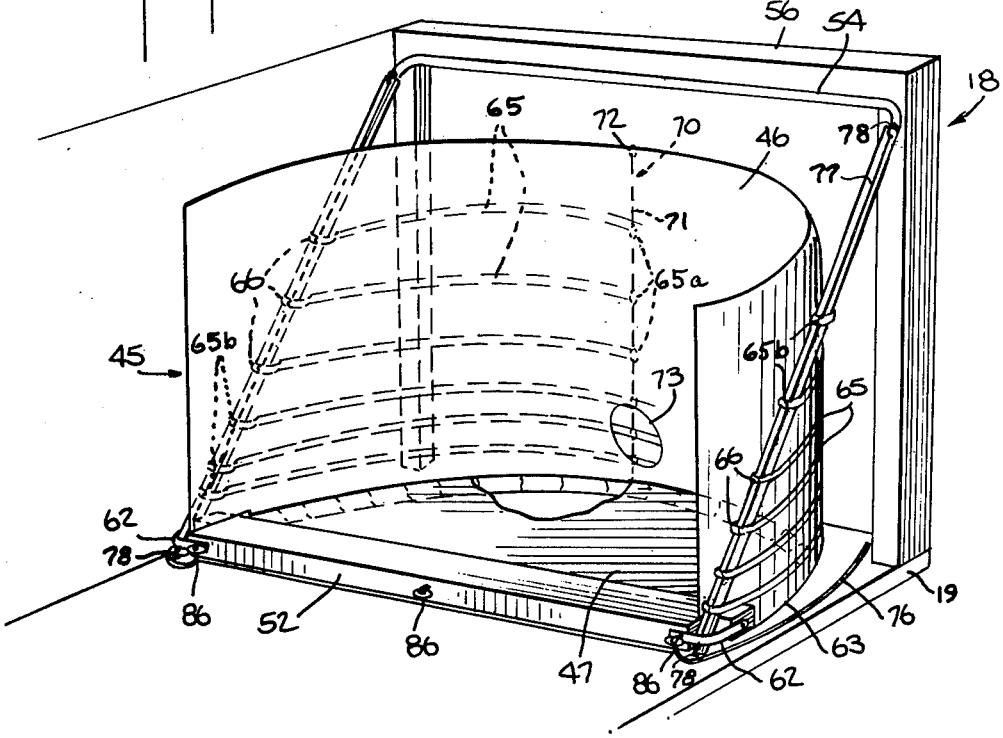
FIG. 3 is a perspective view of a rear frame and bulkhead arrangement assembled in accordance with the invention, and showing its relationship to the rear structural components of the container within which it is situated.
Figure 4:
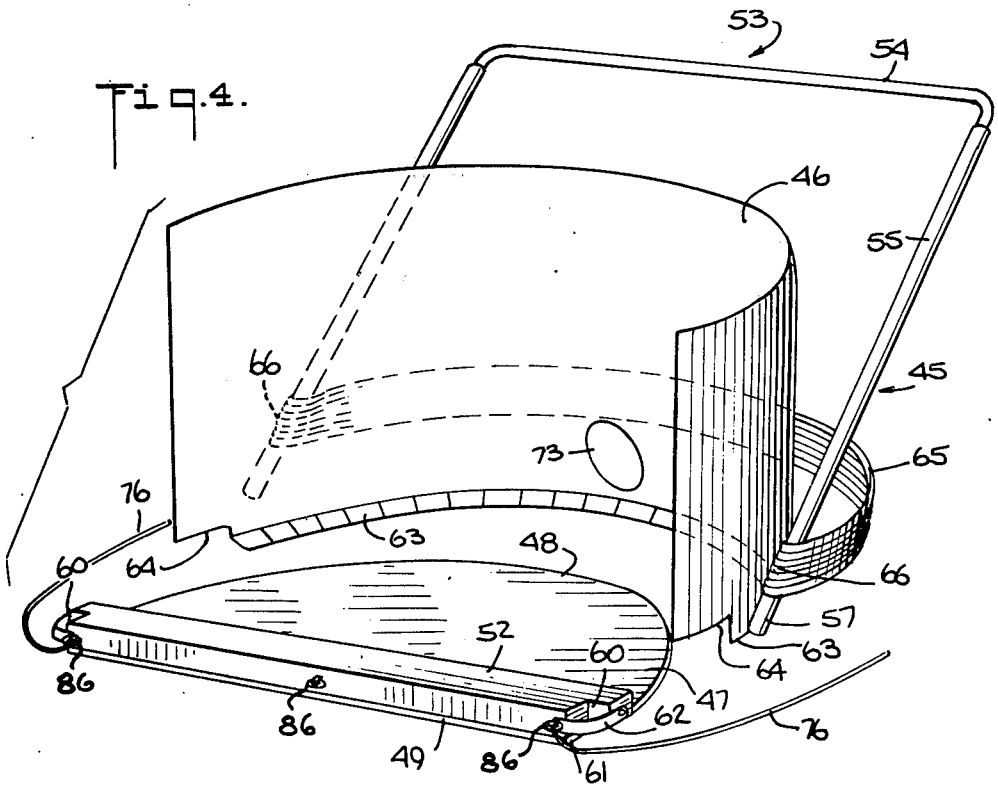
FIG. 4 is an exploded view of the rear frame and bulkhead arrangement of FIG. 3 as seen prior to the assembly being completed.

Referring now to FIGS. 3 and 4, it will be seen that a generally semi-circular base member 47, made from 4 foot × 8 foot board cut on a radius of 4 feet extending from the center of one of the long edges, fits transversely within the container resting on the floor 12. Its curved rear edge 48 serves as a template against which the curvature of the bulkhead member 46 is formed. The base member 47 also has a straight front edge 49. A transverse, bracing or spreader element 52 is attached atop and forms a part of the base member 47 and extends thereacross, adjacent to the front edge 49. The base member 47 and the spreader element 52 both can be made of wood, but in a presently preferred embodiment of the invention the base member 47 is formed of fiber board or pressed board, such as the board distributed under the trademark Masonite, and the spreader element is a wooden spreader about 2 inches thick and 6 inches wide. The base 47 should be sturdy, and fiber board of about ¼ inch thickness is suitable.

To support the bulkhead member 46 a frame 53, having an upper cross member 54 and respective downwardly and forwardly extending side members or legs 55, is provided. The legs 55 are preferably straight lengths of pipe and the cross member 54 preferably has bent ends received in open upper ends of the legs 55, as shown in FIGS. 2–4. Alternatively, the frame 53 can be unitarily formed of tubular pipe bent to a U-shape.

As shown in FIG. 3, the inverted U-shaped frame 53 is of such size that its upper cross member 54 rests against the transverse top header 56 of the rear door frame 18 of the container 10 when the lower ends 57 of the legs 55 are against the container floor 12. As illustrated in the drawings the legs 55 are downwardly and forwardly inclined to stand between the bulkhead member 46 and the sides 13 and 14 of the container. The bracing or spreader element 52 spreads the leg ends 57 apart, and has cut-out portions 60 on the forward sides of its ends above cut-out corners of the base member at 61 to receive the leg ends 57. A strap 62 of flexible yet strong material, such as metal, attached at each end of the bracing element 52 can advantageously serve to position and hold the legs 55 at their ends 57.

A lower edge portion 63 of the semi-cylindrical bulkhead 46 is bent forward to form a flap portion fitted under the curved rear edge 48 of the base member 47, so that forces pressing downward hold the bulkhead member 46 tightly in place. The sheet material of the bulkhead member 46 is cut as indicated with shears or the like to permit such forward bending. It will also be seen that the forward lower corners of the bulkhead member 46 are cut out at 64 to fit over the ends of the bracing member 52.

The rear side of the sheet bulkhead 46 is supported against pressures exerted in normal direction by the cargo within the bag B by a plurality of horizontally, or semi-circumferentially disposed steel straps 65 secured at their ends 66 to the legs 55 of the frame 53. In FIG. 4, which shows the rear bulkhead and frame arrangement in disassembled condition, the straps 65 are shown with their loosely looped ends 66 encircling the legs 55 for vertical hoisting and positioning thereon upon installation of the bulkhead within the container 10.

Since the normal pressure distribution of the cargo load on the bulkhead member 46 provides greater force against the lower area as compared with the upper area of the bulkhead, it is desirable for the reinforcing straps 65 to be closer together within the lower area, as shown in FIGS. 2 and 3, to provide the required additional support. The load distribution can be readily determined by methods known in the art, and the horizontal straps 65 can be vertically spaced accordingly. For simplicity of installation as well as proper vertical positioning and spacing of the straps 65, a strap positioning arrangement 70 is provided. The strap positioning means 70 is shown in FIG. 3 as comprising a cord or string 71 which is tied, as at **65*a* to each of the straps 65 at their midpoints, with the respective lengths of the string between each successive strap 65 being increasingly greater towards the top of the bulkhead. A hook or eye is attached to the upper end of the string 71 for engagement over the upper edge of the bulkhead member 46, as indicated at numeral 72. Similar strap positioning arrangements 77 are provided along the upwardly facing sides of the respective legs 55, the string being tied to each successive strap, as at 65*b*, and the hooks 78 securing the string spacer at the top and bottom of the pipe legs 55. Alternatively, the straps may be positioned and supported at their desired respective elevations using clips or hooks or the like attached to the pipe legs 55 at the several vertically spaced apart locations and projecting outwardly therefrom to receive and hold the respective looped ends 66** of the straps.

The lengths of the successive straps 65 necessarily become shorter from the lowest to the highest strap, because of the slanted orientation of the legs 55. The lengths of the straps 65 will of course depend upon their spacing during use but the assembly can be readily standardized for a standard container arrangement. The upper rear attachment area 22 of the bag is secured along the length of the cross member 54, in a manner similar to the attachment of the front end of the bag to the member 36. The lower rear attachment area 24 can be secured to means on the spreader member 52.

The described internal rear bulkhead and frame assembly 45 of the invention is adequate to support the entire cargo load during tilt-unloading thereof through the rear doorway, and not only eliminates the necessity for external bulkheads used in certain prior systems during unloading but also distributes stresses to the header 56 of the frame 18 during transport rather than to the container doors 15. A further advantage resides in the curved configuration of the bulkhead, being curved on a radius extending from a location within the container 10, which acts as a funnel as the cargo is being poured from the lower rear end of the container 10 and bag B. FIGS. 3 and 4 show a circular-shaped outlet port 73 at the central lower area of the bulkhead member 46, which can be fitted with a stovepipe type transition spout 74 as shown in FIGS. 1 and 2 which, in turn, will receive a tubular conveyor hose (not shown).

To unload cargo the bag B is pierced and cut away over the cofacing area of the aperture 73 in the bulkhead member 46, the container 10 is tilted by lifting its forward end, and a pipe, hose or other known unloading means, if it is attached, can receive the cargo from the bag via the spout 74 through which the cargo pours. As shown in FIG. 2, straps 65 can overlie and retain a plate-like flange 75 of the spout 74 to hold the spout in place.

It should be noted that the bulkhead member 46 is spaced away from the rear doors 15 of the container 10 in the forward direction as shown in FIG. 2 so that cargo load forces are not exerted against the doors themselves. This spacing also permits installation of the spout 74 prior to loading as is desirable, since the doors 15 can be closed even with such a spout 74 in position.

It has been noted that in areas above the bulkhead member 46 the bag B has loading apertures 20 for loading purposes. In FIGS. 1, 2 and 6 these openings are shown to be fitted with sleeves **20*a***, one for connection to a pneumatic feed line for bulk cargo, and the other to permit the exhausting of air from the bag while bulk cargo is being loaded to relieve pressure therein.

The bag B has some freedom or movement, and is resiliently mounted with respect to the frame means 30 and 53 described, to better absorb the shock of shifting of loads during transport, loading and discharge. Reference is now made to FIGS. 6, 7 and 8 which illustrate in detail the means by which the bag B is secured to the front frame 30 and the rear frame and bulkhead assembly 45 according to the invention. FIG. 6 shows the bag B, which as previously indicated can be formed as a tube of polyethylene with closed and squared ends.

The bag B is preferably formed by attaching square end panels 80 to a tubular bag body 81, for example by heat sealing, to produce a generally rectangular and box-like bag. The attachment areas 21, 22, 23 and 24 are then formed by taking up the bag material along transversely extending folds of the bag along and corresponding to the top and bottom front edge areas 21 and 23, the top rear edge area 22, and the area 24 which is located about 4 feet forward of the bottom rear edge. These attachment areas 21–24 are then reinforced against tearing by adhesively securing strips of plastic or canvas tape 82 at spaced locations along the respective areas, as shown in FIGS. 6 and 7. Grommets 83 (FIG. 8) are formed through and secured to the respective tapes 82 along the areas 21–24, as shown in FIG. 7.

One means of attachment to provide the desired resilient response to local stress is illustrated in FIGS. 5 and 7. In that embodiment, a suitable number of keyhole-shaped clips 84 of the inexpensive type commonly used in hanging shower curtains are mounted on the cross member 36 of the front frame and on the upper cross member 54 of the rear frame, and strong rubber bands 85 are looped through the respective grommets 83 and mounted on the respective shower clips 84 as shown in FIG. 7. The elasticity of the rubber bands 85 allows some freedom of movement. Similar mounting of the lower rear attachment area 24 of the bag to the base member spreader 52 is made via only three grommet holes, to which the rubber bands are secured, and three screw eyes 86 (FIGS. 3 and 4) on which the shower clips are mounted. However, in some cases there may be no need to secure the lower rear end of the bag at all. At the lower front area 23 where it is very important to provide restraint against rearward movement of the bag, the attachment means of FIG. 7 are similarly employed along the length of the area.

Figure 8:
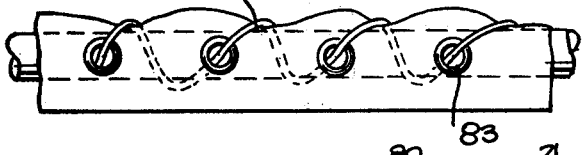
FIG. 8 is a detail showing an alternative attachment means for a flexible liner bag.

An alternative means of securing the grommeted attachment areas 21–24 of the bag to the frame is illustrated in FIG. 8 wherein the grommets are laced to the respective frame cross members 31, 36 and 54, and to the screw eyes 86 at the bottom rear area 24 if provided, by means of commercially available shock cord 87, which is an elastic material.

Whatever the attachment means employed, the installation of a bag B according to the invention can easily be done by two men in a short time. It is contemplated that the bag will be furled or rolled, forming a kit or convenient package with the frames, bulkhead, and base member. The front end frame 30 is first positioned with its bottom cross member 31 against the container floor 12 and front wall 11, and its side members 34 braced between the floor 12 and a roof bow 16 as previously described. The attachment areas 21 and 23 of the bag B are then secured to the members 36 and 31 in accordance with the illustrations of FIG. 7 or 8.

The installers then walk in rearward direction of the container, unrolling or unfurling the bag towards its rear end. The base member 47 is then positioned on the floor of the van and the bag attachment area 24 is secured to its screw eyes 86, if desired. The rear frame legs 55 and cross member 54 are generally positioned between the base member 47 and the top of the container, if not its rear header 56, and the attachment area 22 of the bag B is secured to the upper cross member 54. Then the bulkhead member 46 is positioned behind the bag with its flap portion 63 under the base member curved edge 48, and the reinforcing metal straps 65 are lifted into their vertically spaced relationship by means of the strings 71 and 77, as aforesaid. As an aid to positioning of the rear frame and bulkhead, installation strings 76 are provided as shown in FIGS. 3 and 4. One string 76 is secured to each end of the bracing member 52, and the other end of each string 76 is allowed to trail back toward and out of the open door of the container. By pulling in the rearward direction on these strings 76, the bulkhead and rear frame assembly 45 can be properly positioned with its top cross member 54 against the header 56. At such time the installers are outside of the container 10, behind the doorway frame 18.

It has been found that attachment of the bag B to the rear cross member 54 can be facilitated by inflating the bag, for example, by use of a fan to blow in air through one of the bag openings 20 thereof. Inflation of the bag brings the upper attachment area 22 closer to the cross member 54 to which the bag can then be easily secured.

The bag B is filled with bulk cargo by known means through one of the bag openings 20 and readied for shipment by tying off the sleeves 20*a* and closing and sealing the container doors 15.

Figure 9:
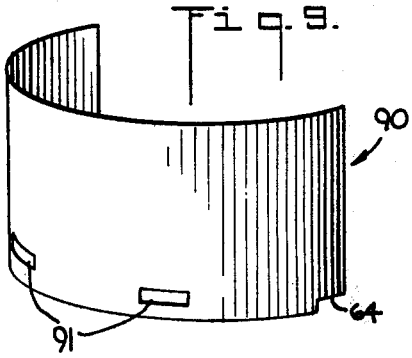
FIG. 9 is a perspective view of an alternative bulkhead member for use in accordance with the invention.

For unloading, and as previously indicated, the bulkhead member 46 can have a centrally located port 73 and a spout fitting 74. However, the present liner arrangement can be adapted to accommodate some existing unloading facilities for containers having bag liners installed in accordance with previously known techniques. Such lined containers, not provided with any internal bulkhead, or with only a cardboard temporary bulkhead, are not safely unloaded upon simultaneous opening of both rear doors 15 of the container. Rather, it is the practice to open only one door during unloading, and therefore the unloading facilities are equipped for off-center reception of cargo. The modified bulkhead member 90 of FIG. 9 can be substituted for the bulkhead member 46 of the invention, if such off-center unloading facilities are to be employed. It will be seen that the bulkhead member 90 differs from the member 46 only in that, instead of a cenral port 73 and spout 74, two off-center, generally rectangular unloading ports 91 are either cut out through the member 90 or outlined by perforations or tear lines for easy opening.

In addition to variations in size among the containers 10 in general use, the locations of roof bows and other container structural members may also vary from one make and model to another, yet it will be found that the frame 30 and frame-and-base assembly 45 can be accommodated within a number of such differently sized and structured vans. For example, for positioning in a standard 8 foot wide by 8½ foot high container, the respective members of the front frame 30 can have dimensions as follows: the lengths of the cross members 31 and 36 are about 92¼ inches; the leg members 34 are 7 feet 11 inches long; and the piping tees 38 are spaced about 1 foot 4½ inches down from the upper ends 35 of members 34. The springs 40 will permit an adjustment of as much as 3 or 4 inches, whereby variations in the spacings of the nearest roof bow 16 from the container front wall 11 in the several makes of containers can be readily compensated for.

In the case of the rear frame assembly 45, the frame legs 55 are 104 inches long and the upper cross member 54 is 91 inches long. Since the rear doorway of an 8 foot × 8½ foot container has an inside opening about 92½ inches wide and 7 feet 10 inches high, it will be seen that the frame 45 can easily be placed in position.

It has been noted that framing members of both the front frame 30 and the rear frame assembly 45 can advantageously and economically be of commercially available steel pipe. It has been found that lengths of the larger diameter pipe, such as those forming the bottom front member 31 and the rear legs 55 which receive ends of other framing members, are sufficiently strong for any normally encountered load if they are made of 1¼ inch diameter pipe. In such case the other comating framing members can be of 1 inch diameter pipe. This illustration is given only by way of example, and it will be recognized that piping made from materials other than steel can be used, and other appropriate sizes thereof, to accommodate the loads to be encountered, can be employed.

Numerous other modifications, substitutions and applications of the invention will suggest themselves to those acquainted with the art. For example, despite the fact that the various elements of the system of the invention cooperate very advantageously, one or more might be omitted or replaced by prior art structures with a corresponding loss of some advantages of the present invention. The system of the invention may also be adapted for use with non-standard size containers, trailers, or other car bodies. These and other modifications are considered to be within the spirit and scope of the invention.

Thus has been described a means for installing and supporting a bulk cargo liner bag in a container, which achieves all of the objects of the invention.

What is claimed is:

1. A kit of component parts capable of being assembled and installed adjacent the rear doorway of a van-type cargo container to support a bulk cargo liner bag within the container, said kit comprising a transverse bulkhead of flexible sheet material, and frame means adapted to support said bulkhead adjacent said rear doorway, said frame means including a pair of said members having respective upper and lower ends of equal length which is greater than the interior height of said container, a cross-member having respective opposite ends and length which is substantially equal to the interior width of said container, said side member upper ends and said opposite ends of the cross-member being adapted to be connected together to connect the cross-member opposite ends to the respective of said side member upper ends to space the side members apart, and a plurality of transverse bulkhead support straps, said transverse bulkhead having a height which is less than the interior height of said container and width to extend between said side members when spaced apart by said cross-member, and each said bulkhead support strap having respective opposite ends adapted to be connected to the respective of said side members for extending the strap therebetween, said plurality of straps having unequal and progressively longer lengths the shortest of which is at least as long as said cross member, whereby, when said cross-member is connected between said side member upper ends and said straps are connected to and extend arcurately between said side members in vertically spaced apart relation therealong in the order to their said progressive lengths with the longest strap adjacent to said side member lower ends, and when said frame means is positioned within the container with its said side members extending angularly and upwardly from their lower ends adjacent the container floor towards the container doorway, the different lengths of said plurality of straps provide a vertically arranged, curved lateral support to hold said bulkhead in vertical orientation.

2. A kit of component parts according to claim 1 which further comprises a base member having opposite ends and length substantially equal to the length of said cross-member to extend between said lower ends of the side members to space them apart, said base member opposite ends having means adapted to receive and retain engagement of said lower ends of the side members when said base member extends therebetween.

3. A kit of component parts according to claim 2 wherein said base member further has a curved rearward edge adapted to engage said bulkhead when in its said vertical orientation, and said vertical bulkhead has a lower edge portion adapted to be folded and received beneath said rearward edge of the base member.

4. A kit of component parts according to claim 1 wherein each of the opposite ends of each said bulkhead support strap has means for slidably mounting the strap end on its said associated side member.

5. A kit of component parts according to claim 4 which futher comprises string means attached to each, and extending between all of said straps for determining their said vertically spaced apart relation.

6. A kit of component parts according to claim 1 wherein said bulkhead sheet material is aluminum.

7. A kit of component parts according to claim 1 wherein said bulkhead sheet material is paperboard.

* * * * *